US008044876B2

(12) United States Patent
Collinet et al.

(10) Patent No.: US 8,044,876 B2
(45) Date of Patent: Oct. 25, 2011

(54) SUBSTRATE PROVIDED WITH AN ELECTROCONDUCTIVE ELEMENT HAVING AN ANTENNA FUNCTION

(75) Inventors: Sebastien Collinet, Barcelona (ES); Jose Jaime Cruzado, Vilanova (ES)

(73) Assignee: Saint-Gobain Glass France, Courbevoie (FR)

( * ) Notice: Subject to any disclaimer, the term of this patent is extended or adjusted under 35 U.S.C. 154(b) by 543 days.

(21) Appl. No.: 12/293,100

(22) PCT Filed: Mar. 26, 2007

(86) PCT No.: PCT/FR2007/051015

§ 371 (c)(1), (2), (4) Date: Sep. 16, 2008

(87) PCT Pub. No.: WO2007/110544

PCT Pub. Date: Oct. 4, 2007

(65) Prior Publication Data

US 2009/0079641 A1 Mar. 26, 2009

(30) Foreign Application Priority Data

Mar. 28, 2006 (FR) ..... 06 51057

(51) Int. Cl.
*H01Q 1/40* (2006.01)

(52) U.S. Cl. ..... 343/873; 343/700 MS; 343/713

(58) Field of Classification Search ..... 343/700 MS, 343/713, 873

See application file for complete search history.

(56) References Cited

U.S. PATENT DOCUMENTS

| | | | |
|---|---|---|---|
| 2003/0034926 | A1 | 2/2003 | Veerasamy |
| 2003/0080921 | A1 | 5/2003 | Wen et al. |
| 2003/0112190 | A1 | 6/2003 | Baliarda et al. |
| 2005/0179594 | A1 | 8/2005 | Morikawa et al. |
| 2006/0022880 | A1 | 2/2006 | Chiang |

FOREIGN PATENT DOCUMENTS

| | | |
|---|---|---|
| EP | 1 313 166 | 5/2003 |
| EP | 1 427 055 | 6/2004 |
| WO | 03 038947 | 5/2003 |

*Primary Examiner* — David G Phan

(74) *Attorney, Agent, or Firm* — Oblon, Spivak, McClelland, Maier & Neustadt, L.L.P.

(57) ABSTRACT

A rigid substrate including at least one electrically conducting element that provides an antenna function to transmit and/or receive electromagnetic signals, the electrically conducting element having a pattern with a fractal geometry. The electrically conducting element is formed from an electrically conductive ink or enamel that is printed directly on the substrate.

23 Claims, 2 Drawing Sheets

SUBSTRATE PROVIDED WITH AN ELECTROCONDUCTIVE ELEMENT HAVING AN ANTENNA FUNCTION

TECHNICAL FIELD

The invention relates to a substrate that includes at least one electrically conducting element which provides an antenna function in order to transmit and/or receive electromagnetic signals.

BACKGROUND

Among known substrates that include electrically conducting elements are window panes, widely used in the automotive field. The electrically conducting elements are usually employed as heating tracks, especially on rear windows, but they may also be placed on a window pane in order to provide an alarm and/or an antenna function thereat.

In practice, the electrically conducting elements consist of metal wires that are formed on an industrial scale by conventional screen-printing of an electrically conducting paste, forming a predetermined pattern, and by firing this paste.

The pattern gives the elements a precise width and a precise thickness depending on the final function of said elements, for example in relation to the desired impedance of an antenna.

Owing to the useful functions (heating, antenna, alarm) provided by these conducting elements, their number on a given window pane has been increasing in recent years, which can pose space constraint and visibility problems. Thus, when the tracks are located in the field of view of the window pane, they are clearly visible from the inside, which may impede the driver, and possibly from the outside, which impairs the aesthetics of the vehicle.

Thus, for a few years now, conducting elements have instead been produced in the form of transparent metal films that are etched or cut into the desired pattern.

Moreover, although several years ago an antenna was dedicated only to receiving radio waves, the growing technology in the telecommunications field is increasingly dictating the provision of antennas endowed with various types of transmission and/or reception characteristics, such as GPS, mobile telephony, etc.

Thus, a vehicle is presently provided with conventional receive antennas, such as conducting wires placed on the rear windows, and with more specific antennas, such as for GPS systems, mobile telephony systems, telepayment systems, etc., which consist of wire antennas or antennas configured in the form of patches and placed for example on the roof of the vehicle, or which consist of transparent conducting films deposited on the window panes.

Since all these applications do not operate at the same frequency, it is necessary to configure a specific antenna for each application. This does not simplify the manufacture of a vehicle and represents additional production and vehicle incorporation costs.

A new type of antenna has recently appeared on the market, called a fractal antenna, which makes it possible with a single device to operate over one or more frequency bands and which also is miniaturized.

A fractal antenna has a pattern with a fractal geometry, that is to say a base pattern that is repeated several times, possibly on a different and homothetic size scale, so as to cover one or more frequency bands.

U.S. Pat. No. 6,300,914 for example describes a fractal antenna in the form of a loop that is 5 to 10 times smaller than an equivalent low-frequency conventional antenna. This antenna is for example formed by a conducting film deposited on a substrate and cut to the desired shape.

Various shapes of antennas having a fractal geometry may be envisaged. Patent application WO 02/01668 thus discloses various patterns, such as triangular, Hilbert curve, Von Koch snowflake and Sierpinski carpet patterns, or a combination of these patterns, the antennas being obtained from conducting films formed on substrates.

These fractal antennas formed by transparent films may also be incorporated into window panes by being deposited on supports, for example flexible plastic films, which are then laminated between two substrates to form the window pane. Document U.S. Pat. No. 6,552,690 shows this type of window pane. However, such a manufacturing process remains complicated to implement.

Such antennas formed on rigid supports, such as plastic supports, but incorporated into rearview mirror assemblies, thus eliminating from view the conventional antennas placed on the roof, are also known.

SUMMARY

The object of the invention is to use this new technology of fractal antennas to provide operation over a wider frequency range, benefiting from a miniaturized size, the production of these antennas having to be simple to implement and having to allow them to be incorporated easily and quickly into the end-use device.

According to the invention, the substrate is rigid and comprises at least one electrically conducting element that provides an antenna function in order to transmit and/or receive electromagnetic signals, the electrically conducting element being formed from an electrically conductive material and having a pattern with a fractal geometry, the substrate being characterized in that the electrically conducting element is formed by an electrically conductive ink or an electrically conductive enamel, and is printed directly on the substrate.

The term "rigid substrate" is understood to mean a substrate exhibiting inherent mechanical strength so that it does not collapse when it is placed vertically on its edge.

Combining an antenna of fractal geometry with a rigid substrate, such as a window pane, has many advantages that are associated with the small size of the antenna, with the type of substrate used, which supports the antenna and here consists of said rigid substrate, with the manner in which this antenna is combined, namely by printing on the substrate, and with the type of conductive material (ink or enamel).

Although the conductive material used is well known for standard antennas of quite large dimensions compared with the window pane incorporating it, thereby having visibility and frequency range limitation drawbacks, it is not obvious that this material can also be used for antennas of much smaller size and exhibiting fractal geometries.

As regards miniaturization of the antenna, the following advantages may in particular be mentioned:

- great flexibility in patterns of the antenna, its dimensions and its shape, while permitting operation over one or more frequency bands;
- a reduction in the area occupied compared with conventional antennas of the prior art in particular a length divided by at least 2;
- the possibility of printing a number of fractal antennas on the same substrate without thereby covering a large area of the substrate;
- the possibility of positioning the antenna at various points on the substrate so as to be substantially concealed, for example near a marking element, or hidden behind the mount for the interior rearview mirror or of the rain sensor for a vehicle window pane; and the possibility of choosing the most appropriate location on the window pane according to the shape, size and curvature of the window pane.

Printing the antenna directly on the rigid substrate that is in particular intended to be used as a visible substrate, for example a transparent window, offers in particular the following advantages:

greater effectiveness than on plastic substrates that are then incorporated in a concealed manner in the vehicle accessories, the antenna placed on a visible substrate such as a window pane being closer to the exterior environment;

the elimination of externally visible antennas positioned for example on the roof of the vehicle;

the possibility of using the printed antenna as an attractive element of the current window pane around the marking element;

the possibility of adapting the antenna model, one part possibly constituting an antenna of fractal geometry while the other part possibly being a standard antenna;

a reduction in the weight of the antenna and a reduction in the manufacturing and vehicle incorporation costs, since it is unnecessary to have intermediate supports for the antenna, as in the prior art;

the rigid substrate, which already constitutes a device for incorporating various functionalities, thus provides an additional functionality with ease and without any impediment. This type of antenna gives a window pane added value;

for a vehicle window, the assurance of effective protection against vandalism, as the antenna is incorporated into the window pane and therefore into the vehicle, and not, as in the prior art, fitted in an accessory easily accessible for violating; and improved durability, since, for a vehicle window pane application, the antenna is placed inside the vehicle and therefore not exposed to external environmental stresses.

As regards deposition of the antenna by printing, this makes it possible to use any type of rigid substrate, irrespective of its colour or its thickness, and to easily adapt the colour of the conductive material to be deposited so as to harmonize with the colour of the window pane and/or of the vehicle.

In addition, the manufacturing costs of the antenna and its incorporation into its final application are not particularly increased since printing on the rigid substrate is directly incorporated into the manufacture of the final product such as a window intended to be mounted in a vehicle. By printing with an enamel or an ink, it is possible easily to control the necessary density of the material (thickness, width) in order to provide the suitable antenna pattern.

According to one printing embodiment, the electrically conductive material is screen-printed.

According to another embodiment, the electrically conductive material is printed by an ink or enamel jet, without the use of a mask, but using suitable tools to ensure pattern exactitude and precision.

According to yet another embodiment, the electrically conductive material is printed by applying it through a mask, the application being carried out by spraying, or with the aid of a roll or using a continuous ink or enamel jet curtain.

According to yet another variant, the electrically conductive material is printed by electrophotography.

Moreover, the substrate has no protective coating for the antenna. The term "coating" is understood to mean any layer or film that would be combined with the substrate, coating the antenna directly. This is because the ink or enamel associated with the rigid substrate has the advantage of requiring no protective coating.

The rigid substrate corresponds to any material suitable for printing with enamel or ink, for example glass, whether this be a mineral glass or an organic glass such as polycarbonate or polymethyl methacrylate.

Advantageously, the ink or enamel is more resistant when it is fired during a heat treatment on the substrate, which is then made of glass, for example when the glass substrate has to undergo a toughening and/or bending operation.

According to one feature, the material includes electrically conducting elements with a weight content between 60% and 80%. For example, the conductive enamel is a silver-based paste.

The substrate may have, over at least part of its surface, for example over all or part of its periphery and as border, a black enamel on which the electrically conducting antenna element is printed. Thus, the antenna may be concealed from view when an observer looks through the substrate from the opposite side from that bearing the black enamel.

Advantageously, the substrate may be a transparent viewing means.

The substrate is intended in particular to constitute at least one sheet of mineral or organic glass of a window pane, especially a window pane that has undergone a heat treatment if it is made of mineral glass, for the purpose of use in a means of locomotion or in a building.

Without being restrictive, the following means of locomotion may be considered: motor vehicles, aircraft, trains, etc.

The use of antennas in buildings is finding increasing applications in the current telecommunications technology, the window pane constituting, both on the outside and on the inside of the building, a functional use other than the primary function of a transparent means of vision.

Since the antenna is applied directly to the substrate, such as a sheet of glass, this may then be used in the desired manner for its intended application, both for forming monolithic glazing and for manufacturing laminated glazing or insulating glazing (whether the antenna is facing the gas layer or away from it).

The invention also proposes a novel use of electrically conducting ink or an electrically conducting enamel for forming at least one antenna on a rigid substrate, characterized in that the antenna has a fractal geometry.

BRIEF DESCRIPTION OF THE DRAWINGS

Other features and advantages of the invention will now be described with regard to the figures in which.

DETAILED DESCRIPTION

Figure 1:
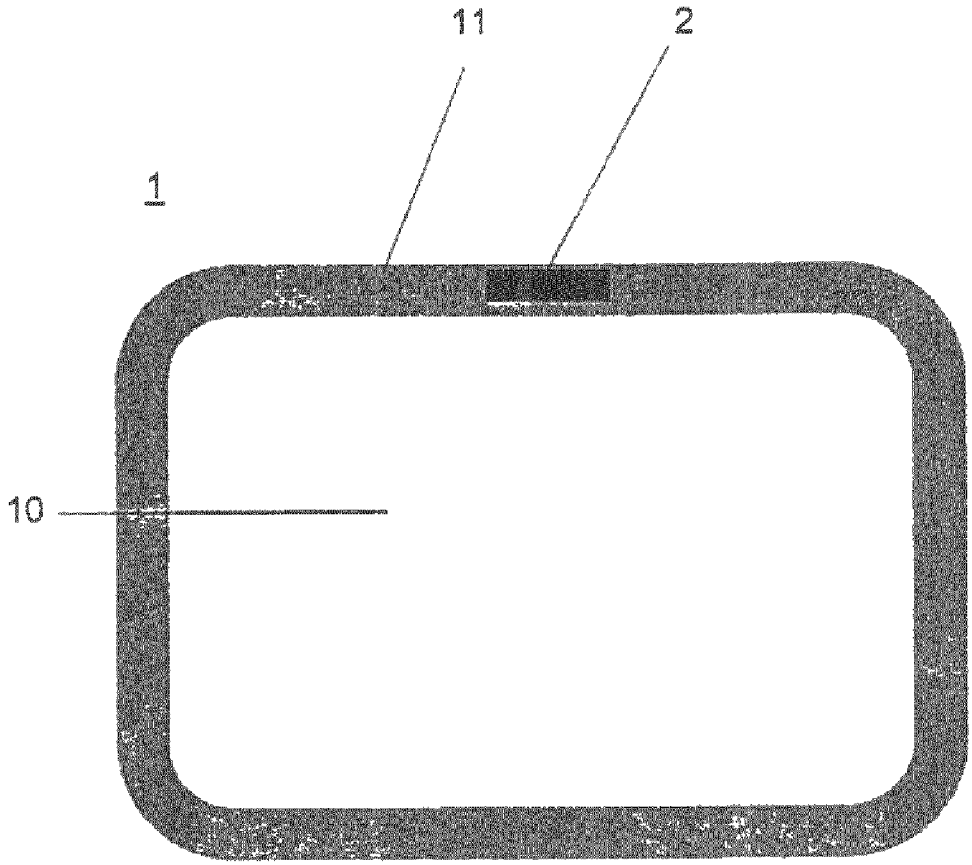
FIG. 1 is a schematic view of a substrate according to the invention.

FIG. 1 illustrates a window pane 1 comprising a glass substrate 10 that has undergone a heat treatment and includes an antenna structure 2 according to the invention.

The substrate could just as well be made of polycarbonate or polymethyl methacrylate, which are rigid plastics suitable in particular for receiving conductive ink or paste, especially by screen printing.

The window pane is intended to be used for example in a motor vehicle, as a windscreen, rear window, side window, roof or rearview pane. The shape illustrated here is schematic—any shape of window pane or glazed wall, which is adapted to the device for which the window pane or wall is intended, is conceivable.

Figure 2:
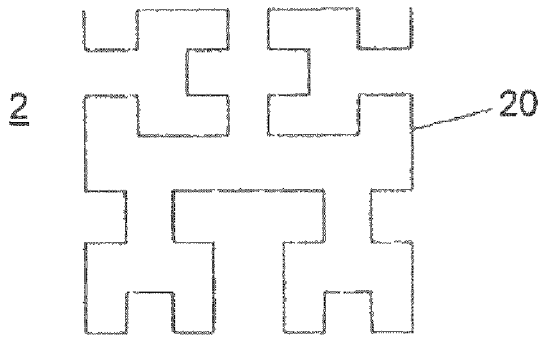
FIG. 2 is a detailed view of the antenna of the substrate according to one configuration example.

The antenna structure 2 is an antenna with a fractal geometry (FIG. 2). This antenna comprises an electrically conducting element 20 in the form of segments arranged in series and in parallel, in such a way that they form a pattern that repeats itself several times, possibly on different and homothetic size scales.

The pattern shown in FIG. 2 is one example. Other patterns may be envisaged, suitable for the positioning of the antenna on the window pane or for the application for which the antenna is intended.

The particular feature of this antenna is to be able to operate over a number of frequency bands, while still being small in size. Thus, for example using an area of around 10 to 50 $cm^2$, it occupies only a small part of the window pane, unlike the standard antennas.

In the case of the exemplary embodiment shown, the antenna is installed on the edge of the window pane, but obviously it can be installed at any other point on the window pane, and preferably at a point where it functions most appropriately.

Once it has been fitted into the receiving device, the window pane has the antenna on its internal face, that exposed to the interior of the device, for example the interior of the vehicle.

As usual for a vehicle window pane, this is provided with a black enamel 11 placed as a border of the window pane or over its entire periphery. The conductive material of the antenna 2 is for example made of an enamel of different colour and can be deposited on the black enamel or on the transparent surface of the window pane.

The window pane may include several fractal antennas. These antennas may be placed at several points on the window pane.

Figure 3:
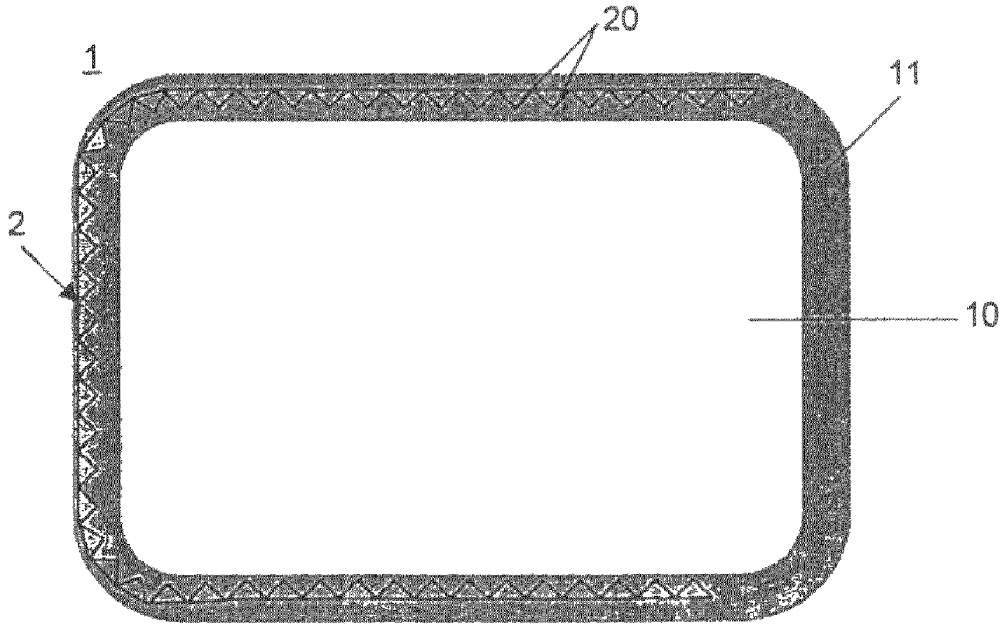
FIGS. 3 and 4 are schematic views of other embodiments of a substrate according to the invention.

It is also possible to produce a geometric shape consisting of a plurality of conducting elements 20, which, when butted together, provide one or more antennas the electrical conductor length of which may be tailored to the targeted frequency range(s) for the use of such antennas. Thus, it is possible to envisage an antenna running along a part, or even all, of the periphery of the window pane, while still being of small width, not exceeding 7 cm for example, as it is possible in particular to be concealed by the black enamel 11 on the border of the window pane. FIG. 3, which is again schematic as regards the shape of the antenna, is thus an example of this.

Figure 4:
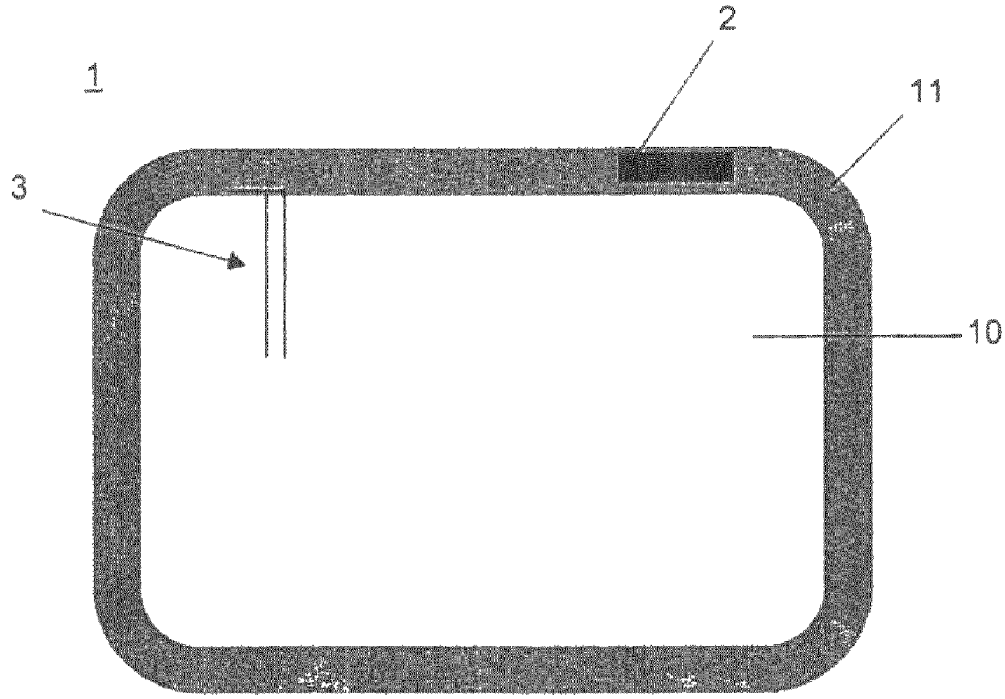

The same window pane may include, as can be seen in FIG. 4, at least one fractal antenna 2 and a standard antenna 3.

The conducting element 20 is made of an electrically conducting ink or paste to be fired, such as a silver-based material, with a weight content between 60% and 80%.

Preferably, the material has a resistance of less than 10 ohms/m. The resistivity of the material is preferably about 5 $\mu\Omega\cdot cm$ so as to allow, after firing, better brazing for connecting the antenna to a current lead conductor (not shown here).

The material is preferably applied by screen printing on the surface of the glass and is fired in the surface of the glass during the thermal forming process.

In other alternative ways of printing the material, the conducting ink or enamel is applied through an appropriately patterned mask, by various methods such as by spraying, by the use of a roll or by sending a continuous ink jet curtain.

It is also possible to use an ink or enamel jet without the need for a mask, the tools employed being suitable for ensuring the exactitude and precision of the desired pattern.

Finally, another method consists of electrophotography.

Within the context of printing by screen printing, the screen employed may be obtained by the photographic technique, known per se, which consists in covering the surface of the screen with a layer or film of photocrosslinkable resin and in projecting a transparency so as to reproduce the printing pattern on the screen.

The nature of the constituent threads of the screen is preferably polyester, and each thread consists of a single thread with a diameter of between 40 and 80 μm.

The squeegee that allows the paste to be pressed through the screen-printing screen may be a standard squeegee having a right-angled, bevelled or rounded printing edge. Preferably, the squeegee is made of a material of the polymer type, for example a polyurethane, having a Shore A hardness between 65 and 85.

Screen printing allows the thickness and the width of the conducting elements to be optimally adjusted. After firing, the elements have in particular a thickness of less than 5 μm and a width of around 0.5 mm.

In the case of a window pane provided with a transparent electrically conducting film, such as one that reflects infrared radiation, the fractal antenna will have to be deposited on a surface of the substrate from which the transparent conducting film has been removed.

The invention claimed is:

1. A rigid substrate comprising:

at least one electrically conducting element that provides an antenna function to transmit and/or receive electromagnetic signals, the at least one electrically conducting element being formed from an electrically conductive material and including a pattern with a fractal geometry, wherein the at least one electrically conducting element includes an electrically conductive enamel, which is printed directly on the substrate.

2. A substrate according to claim 1, wherein the electrically conductive material is screen-printed.

3. A substrate according to claim 1, wherein the electrically conductive material is printed by an enamel jet without use of a mask.

4. A substrate according to claim 1, wherein the electrically conductive material is printed by applying the electrically conductive material through a mask, via spraying, or with aid of a roll, or using a continuous enamel jet curtain.

5. A substrate according to claim 1, wherein the electrically conductive material is printed by electrophotography.

6. A substrate according to claim 1, wherein the substrate has no protective coating for the at least one electrically conducting element.

7. A substrate according to claim 1, wherein the substrate is made of glass.

8. A substrate according to claim 1, wherein the substrate is made of polycarbonate or polymethyl methacrylate.

9. A substrate according to claim 1, wherein the enamel is fired on the substrate during a heat treatment.

10. A substrate according to claim 1, wherein the electrically conductive material includes electrically conducting components with a weight content between 60% and 80%.

11. A substrate according to claim 1, wherein the conductive enamel is a silver-based paste.

12. A substrate according to claim 1, further comprising, over at least part of its surface, a black enamel on which the at least one electrically conducting element is printed.

13. A substrate according to claim 1, comprising a plurality of electrically conducting elements having a fractal geometry to form a plurality of fractal antennas.

14. A substrate according to claim 1, further comprising at least one standard antenna.

15. A substrate according to claim 1, wherein the substrate is a transparent means of vision.

16. A substrate according to claim 1, wherein the substrate is at least one sheet of mineral or organic glass of a window pane.

17. A substrate according to claim 16, wherein the window pane is incorporated into a locomotion device or a motor vehicle.

18. A substrate according to claim 16, wherein the window pane is incorporated into a building wall.

19. A laminated or insulated glazing comprising the substrate of claim 1.

20. An antenna on a rigid substrate, comprising:

electrically conductive enamel forming at least one antenna on the rigid substrate, wherein the at least one antenna has a fractal geometry.

21. The antenna according to claim 20, wherein the rigid substrate includes, over at least part of a surface thereof, a black enamel on which the at least one antenna is printed.

22. The antenna according to claim 20, wherein the rigid substrate includes at least one sheet of mineral or organic glass of a window pane for a locomotion device or a building.

23. A rigid substrate comprising:

at least one electrically conducting element that provides an antenna function to transmit and/or receive electromagnetic signals, the at least one electrically conducting element including an electrically conductive material and being disposed in a pattern with a fractal geometry, wherein the at least one electrically conducting element includes an electrically conductive ink, which is printed directly on the substrate, and wherein the electrically conductive material includes electrically conducting components with a weight content between 60% and 80%.

* * * * *